US008050439B2

(12) United States Patent
Inoshita et al.

(10) Patent No.: US 8,050,439 B2
(45) Date of Patent: Nov. 1, 2011

(54) HEARING AID SYSTEM

(75) Inventors: Junichi Inoshita, Ehime (JP); Yasushi Ueda, Ehime (JP); Yasushi Imamura, Ehime (JP); Hiroyoshi Inoshita, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/922,755

(22) PCT Filed: May 17, 2010

(86) PCT No.: PCT/JP2010/003312

§ 371 (c)(1),
(2), (4) Date: Sep. 15, 2010

(87) PCT Pub. No.: WO2010/137250

PCT Pub. Date: Dec. 2, 2010

(65) Prior Publication Data

US 2011/0033073 A1 Feb. 10, 2011

(30) Foreign Application Priority Data

May 25, 2009 (JP) ..... 2009-124876
Feb. 26, 2010 (JP) ..... 2010-041518

(51) Int. Cl.
*H04R 25/00* (2006.01)

(52) U.S. Cl. ..... 381/323; 381/23.1; 381/314

(58) Field of Classification Search ..... 381/23.1, 381/60, 312, 314, 315, 320, 321, 323; 455/343.1, 455/574, 573
See application file for complete search history.

(56) References Cited

U.S. PATENT DOCUMENTS 5,870,685 A * 2/1999 Flynn ..... 455/573
6,711,271 B2 * 3/2004 Hou ..... 381/323
7,120,500 B1 10/2006 Seligman
7,545,944 B2 * 6/2009 Allegro Baumann et al. ..... 381/23.1

(Continued)

FOREIGN PATENT DOCUMENTS

AU 2008202727 1/2009

(Continued)

OTHER PUBLICATIONS

Supplementary European Search Report issued May 24, 2011 in Application No. EP 10 75 4397.

*Primary Examiner* — Huyen D Le
(74) *Attorney, Agent, or Firm* — Wenderoth, Lind & Ponack, L.L.P.

(57) ABSTRACT

This hearing aid system comprises a first hearing aid (1) and the second hearing aid (2) mounted on the right ear. These each have a microphone (101) for inputting ambient sound, a hearing aid processor (102) for subjecting sound inputted from the microphone (101) to hearing aid processing, a speaker (103) for outputting sound that has undergone the hearing aid processing, a communication component (107) for performing wireless communication, and a battery (104) for supplying electrical power to the microphone (101), the hearing aid processor (102), the communication component (107), and the speaker (103). The first hearing aid (1) and the second hearing aid (2) have a battery charge detector (105) for detecting the remaining charge of the battery. A power consumption controller (106) is provided for reducing the power consumption for whichever of the first hearing aid (1) and the second hearing aid (2) that has the lowest remaining battery charge when it has been detected that the difference in the remaining battery charges of the first hearing aid (1) and the second hearing aid (2) detected by the battery charge detector (105) is greater than a specific value.

15 Claims, 8 Drawing Sheets

U.S. PATENT DOCUMENTS

| | | | |
|---|---|---|---|
| 7,580,535 | B2 | 8/2009 | Baechler |
| 2004/0208332 | A1 | 10/2004 | Baechler |
| 2005/0259838 | A1 | 11/2005 | Barthel et al. |
| 2006/0023907 | A1 | 2/2006 | Kasztelan |

FOREIGN PATENT DOCUMENTS

| | | |
|---|---|---|
| CA | 2 402 470 | 10/2001 |
| EP | 1 293 106 | 3/2003 |
| EP | 1 558 059 | 7/2005 |
| JP | 5-344595 | 12/1993 |
| JP | 2002-542635 | 12/2002 |
| JP | 2003-530811 | 10/2003 |
| JP | 2007-336460 | 12/2007 |
| JP | 2008-177920 | 7/2008 |
| JP | 2009-17557 | 1/2009 |
| WO | 01/78449 | 10/2001 |

* cited by examiner (a)

(b)

HEARING AID SYSTEM

TECHNICAL FIELD

The present invention relates to a hearing aid system that performs wireless communication between hearing aids mounted on the left and right ears.

BACKGROUND ART

A conventional hearing aid has a mode switching function in which the hearing aid characteristics are modified to suit the surrounding environment. When such hearing aids are mounted on both ears, the left and right hearing aid effects need to be balanced to avoid causing the user discomfort. In view of this, there has been disclosed a hearing aid system in which the hearing aids mounted on the two ears communicate wirelessly with each other to synchronize mode switching (see Patent Literature 1, for example).

PRIOR ART PUBLICATIONS

Patent Citations

Patent Citation 1: Japanese translation of a PCT international patent application No, 2002-542635

SUMMARY

Even when the left and right hearing aids are thus synchronized and thereby operated in substantially the same way, the life of the batteries that supply power to the left and right hearing aids will still be different. This difference is particularly pronounced when the user's gain characteristics vary between the left and right ears. Accordingly, the batteries need replacement at different times for the left and right hearing aids, which means that battery replacement has to be performed more often.

In view of this, it is an object of the present invention to make complications of battery replacement reduced by allowing the batteries to be replaced at substantially the same time for the left and right hearing aids, and to allow the hearing aid with higher power consumption to be used for a longer time.

To achieve this object, the hearing aid system of the present invention comprises a first hearing aid and a second hearing aid mounted on the left and right ears. The first hearing aid and the second hearing aid each have a microphone configured to input ambient sound, a hearing aid processor configured to subject sound inputted from the microphone to hearing aid processing, a speaker configured to output sound that has undergone the hearing aid processing, a communication component configured to perform wireless communication between the first hearing aid and the second hearing aid, a battery configured to supply electrical power to the microphone, the hearing aid processor, the communication component, and the speaker, and a battery charge detector configured to detect the remaining charge of the battery. A power consumption controller is provided to the first hearing aid and to the second hearing aid configured to reduce the power consumption for whichever of the first hearing aid and the second hearing aid that has the lowest remaining battery charge when it has been detected that the difference in the remaining battery charges of the first hearing aid and the second hearing aid detected by the battery charge detector is greater than a specific value.

Another hearing aid system of the present invention comprises a first hearing aid and the second hearing aid mounted on the left and right ears. The first hearing aid and the second hearing aid each have a microphone configured to input ambient sound, a hearing aid processor configured to subject sound inputted from the microphone to hearing aid processing, a speaker configured to output sound that has undergone the hearing aid processing, a communication component configured to perform wireless communication between the first hearing aid and the second hearing aid, a battery configured to supply electrical power to the microphone, the hearing aid processor, the communication component, and the speaker, a battery charge detector configured to detect the remaining charge of the battery, and an environment identifier configured to judge the environment from the ambient sound inputted from the microphone. A power saving decider is provided for detecting that the difference in the remaining battery charges of the first hearing aid and the second hearing aid detected by the battery charge identifier is greater than a specific value, and performing control so that the power consumption is reduced for whichever of the first hearing aid and the second hearing aid that has the lowest remaining battery charge according to what was detected by the environment identifier.

ADVANTAGEOUS EFFECTS

With the hearing aid system of the present invention, the power consumption is reduced for the hearing aid with the lowest remaining battery charge, which allows the batteries of the left and right hearing aids to be replaced at substantially the same time, and also extends the usage time and makes complications of battery replacement reduced.

DETAILED DESCRIPTION OF THE PREFERRED EMBODIMENTS

An embodiment of the hearing aid system of the present invention will now be described in detail through reference to the drawings.

Embodiment 1

Figure 1:
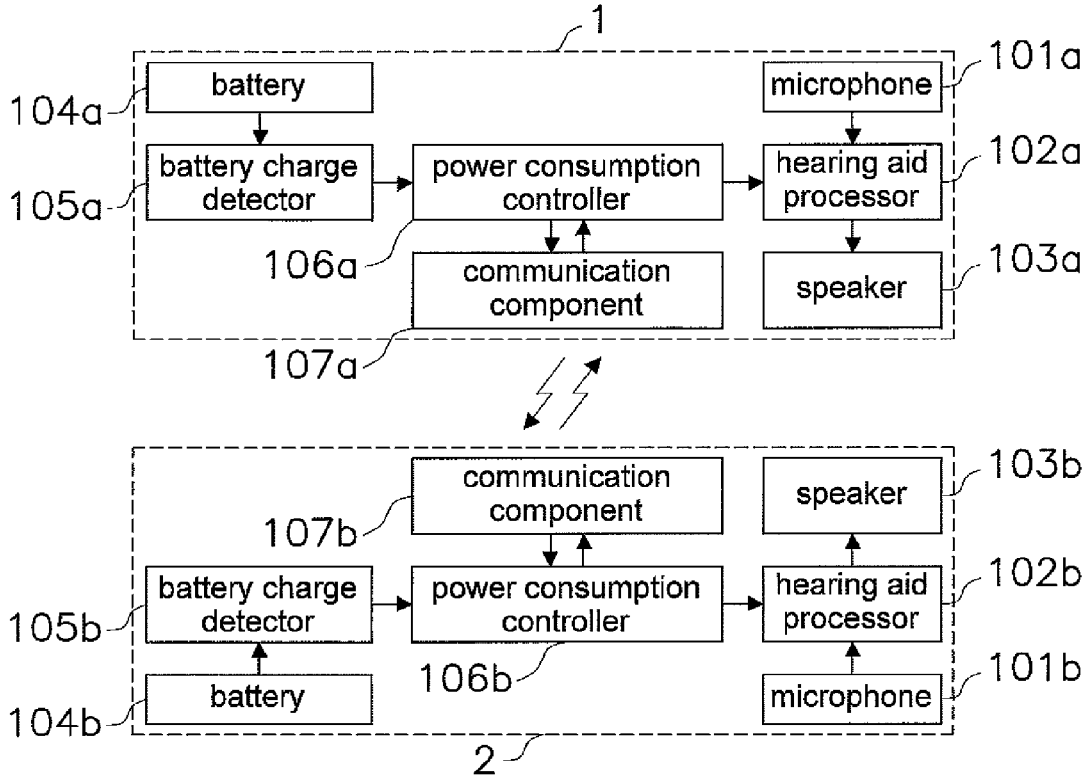
FIG. 1 is a function block diagram of the hearing aid system pertaining to Embodiment 1 of the present invention.

FIG. 1 is a function block diagram of the hearing aid system in Embodiment 1. As shown in FIG. 1, the hearing aid system comprises a first hearing aid 1 mounted on one ear and a second hearing aid 2 mounted on the other. For example, the first hearing aid 1 functions as the master and the second hearing aid 2 functions as the slave.

The first hearing aid 1 has a microphone 101*a*, a hearing aid processor 102*a*, a speaker 103*a*, a battery 104*a*, a battery charge detector 105*a*, a power consumption controller 106*a*, and a communication component 107*a*.

The second hearing aid 2 is similar to the first hearing aid 1, and has a microphone 101*b*, a hearing aid processor 102*b*, a speaker 103*b*, a battery 104*b*, a battery charge detector 105*b*, a power consumption controller 106*b*, and a communication component 107*b*.

The microphones 101*a* and 101*b* convert collected speech signals into electrical signals, and output the converted electrical signals.

The hearing aid processors 102*a* and 102*b* output electrical signals obtained by subjecting the electrical signals outputted from the microphones 101*a* and 101*b* to various kinds of signal processing. The various kinds of signal processing here include basic hearing aid processing, namely, frequency analysis and amplification processing, and additional processing such as noise suppression processing, howling suppression processing, directionality matching processing, and environment identification processing.

The speakers 103*a* and 103*b* convert the electrical signals outputted from the hearing aid processors 102*a* and 102*b* into speech signals, and output them as speech.

The batteries 104*a* and 104*b* supply power for operating the hearing aids. The battery charge detectors 105*a* and 105*b* acquire the remaining battery charge of the batteries 104*a* and 104*b*, and transmit the remaining battery charges to the power consumption controllers 106*a* and 106*b*. The power consumption controllers 106*a* and 106*b* acquire the remaining battery charge of the batteries 104*a* and 104*b*.

The power consumption controller 106*b* of the second hearing aid 2 that functions as the slave sends messages through the communication component 107*b* to the communication component 107*a* of the first hearing aid 1 that functions as the master. The remaining battery charge of the battery 104*b* is transmitted to the power consumption controller 106*a* on the first hearing aid 1 side.

The power consumption controller 106*a* compares the remaining battery charges of the battery 104*a* and the battery 104*b*, and if the difference in remaining battery charges is over a specific range, it suppresses the power consumption of the battery with the lowest charge and thereby reduces the power consumption.

If the remaining battery charge of the first hearing aid 1 is lower than the remaining battery charge of the second hearing aid 2, the hearing aid processing of the first hearing aid 1 is controlled so as to suppress the power consumption of the first hearing aid 1. A notification is sent through the communication components 107*a* and 107*b* to the power consumption controller 106*b* so that the second hearing aid 2 will be a normal power consumption.

On the other hand, if the remaining battery charge of the second hearing aid 2 is lower than the remaining battery charge of the first hearing aid 1, the first hearing aid is kept at normal power consumption, and a notification is sent through the communication components 107*a* and 107*b* to the power consumption controller 106*b* so that the second hearing aid 2 goes into low power consumption mode.

If the difference between the remaining battery charges of the first hearing aid 1 and the second hearing aid 2 is within a specific range, the first hearing aid 1 is kept at normal power consumption, and a notification is sent through the communication components 107*a* and 107*b* to the power consumption controller 106*b* so that the second hearing aid 2 goes to normal power consumption.

The operation of this hearing aid system constituted as above will now be described through reference to FIGS. 2 to 4.

Figure 2:
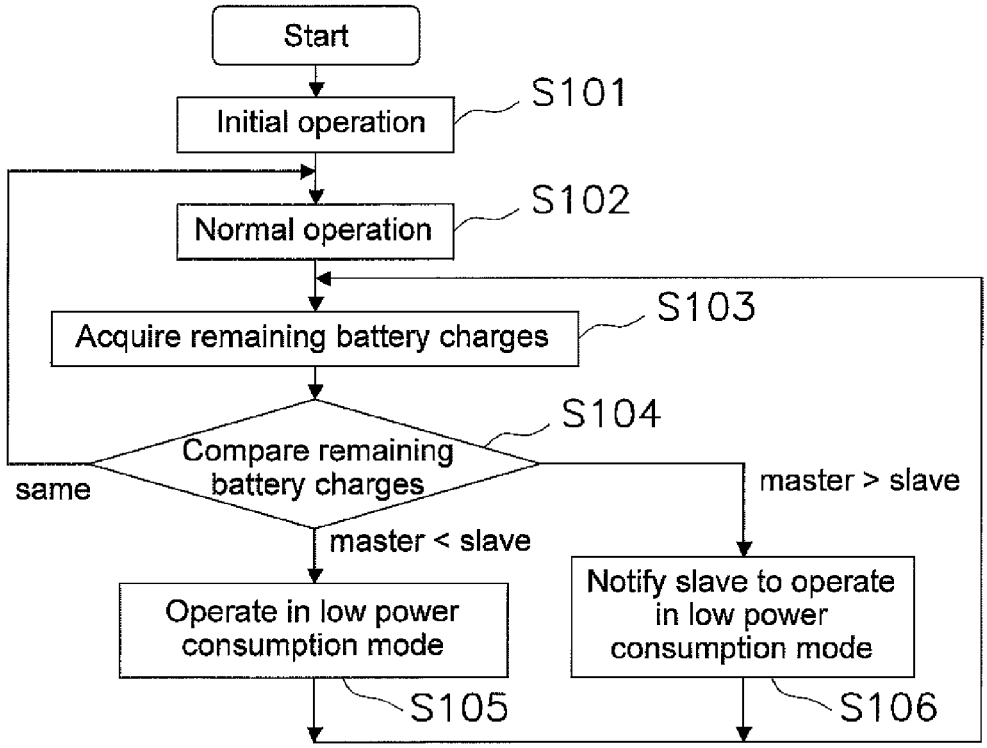
FIG. 2 is a flowchart of the operation of the hearing aid serving as the master.

FIG. 2 is a flowchart of the hearing aid 1 that functions as the master.

First, power is switched on to the first hearing aid 1 and the second hearing aid 2, and as the initial operation of step S101 it is confirmed that the first and second hearing aids 1 and 2 are able to communicate with each other. The hearing aid processor 102*a* executes initialization of the hearing aid processing. This is the preparation for commencing hearing aid processing such as setting the initial value or zero setting.

Next, in step S102, the electrical signal acquired from the microphone 101*a* is subjected to the above-mentioned hearing aid processing by the hearing aid processor 102*a*. This is what is known as normal operation, in which various kinds of signal processing are carried out as necessary. Here, in addition to basic hearing aid processing in which an electrical signal acquired from the microphone 101*a* is subjected to frequency analysis and amplification processing, normal processing also includes additional processing such as the above-mentioned noise suppression processing.

An example of hearing aid processing in this normal operation will now be described.

In frequency analysis, 128-point FFT or the like is used to calculate the level for each frequency on the basis of an electrical signal. An output signal is produced by imparting gain nonlinearly according to the level of each frequency in the amplification processing, and subjecting the level of each frequency to which gain was imparted to reverse FFT.

Then, in step S103, the battery charge detector 105*a* subjects the output voltage of the battery 104*a* to A/D conversion, and outputs the voltage value as the remaining battery charge to the power consumption controller 106*a*. The communication component 107*a* outputs to the power consumption controller 106*a* the remaining battery charge of the second hearing aid 2 received by communication with the communication component 107*b*. This remaining battery charge of the second hearing aid 2 is the voltage value of the battery 104*b* acquired by the battery charge detector 105*b*, and is transmitted through the power consumption controller 106*b* to the communication component 107*b*. At this point it is even better if the variance in the acquired voltage value is taken into account by calculating the average voltage value from among values acquired a number of times.

Another way to find the remaining battery charge is to monitor the output current of the batteries 104*a* and 104*b*, and use the cumulative time over which this current was outputted, that is, the cumulative time calculated by subtracting the total usage time from the total usable time of the batteries 104*a* and 104*b*.

Next, in step S104, the remaining battery charge of the first hearing aid 1 that functions as the master is compared with the remaining battery charge of the second hearing aid 2 that functions as the slave.

Here, if the remaining battery charge of the first hearing aid 1 on the master side is lower, the flow moves to step S105. On the other hand, if the remaining battery charge of the second hearing aid 2 on the slave side is lower, the flow moves to step S106. Alternatively, if the remaining battery charges of the first and second hearing aids 1 and 2 are at the same level, the flow moves to step S102. The allowable range for remaining battery charge here is ±1%. If the remaining battery charge of the second hearing aid 2 on the slave side is within a range of ±1% of the remaining battery charge of the first hearing aid 1 on the master side, then it is concluded that the remaining battery charges of the first and second hearing aids 1 and 2 are at the same level, the flow moves to step S102, and normal operation is continued without moving to low power consumption mode.

Meanwhile, if the difference between the remaining battery charges of the first and second hearing aids 1 and 2 is outside the above range, then the flow moves to step S105 or step S106, and the hearing aid on either the master side or the slave side is moved to low power consumption mode. Even if the same voltage is supplied from the batteries, the value of the voltage acquired by the battery charge detectors 105*a* and 105*b* may vary due to individual differences between the hearing aids, in which case calibration is performed in advance, and an offset is provided to the remaining battery charge of either the first hearing aid 1 or the second hearing aid 2.

Step S105 will now be described. This is a step in which the first hearing aid 1 on the master side is put in low power consumption mode. Here, the power consumption controller 106*a* of the first hearing aid 1 on the master side instructs the hearing aid processor 102*a* to switch hearing aid processing. The hearing aid processor 102*a* halts part of the hearing aid processing, replaces the hearing aid processing, etc., in order to cut down on power consumption.

In this embodiment, the halting of noise suppression processing will be described as an example of processing for cutting down on power consumption. When the noise suppression processing is performed with software, processing is halted by not computing, and power consumption can be cut by an amount corresponding to the computation processing of the processor. On the other hand, if the noise suppression processing is performed with hardware, it is accomplished by stopping the supply of power to the circuit that handles the noise suppression processing. Here, stopping the noise suppression processing is performed whenever it is necessary to change the hearing aid processing flow, settings, etc.

As to processing that is halted to cut power consumption, this is preset, and one or more processing events are halted. For example, instead of stopping noise suppression processing, environment identification processing may be stopped, or both noise suppression processing and environment identification processing may be stopped. Also, in the initial stage of low power consumption mode, as long as one processing event is stopped and the difference between remaining battery charges increases in this state, two or three processing events may be stopped instead.

Step S106 will now be described. This is a step in which the second hearing aid 2 on the slave side is put in low power consumption mode without changing the power consumption of the first hearing aid 1 on the master side from what it is normally. Here, the power consumption controller 106*a* of the first hearing aid 1 on the master side instructs the hearing aid processor 102*a* to perform normal processing, and notifies the power consumption controller 106*b* of the second hearing aid 2 on the slave side to switch hearing aid processing. The operation of the power consumption controller 106*b* upon receipt of this notification will be discussed below.

The method for notifying the power consumption controller 106*b* to switch hearing aid processing will now be described.

First, the command for switching hearing aid processing is preset. Then, at the power consumption controller 106*a*, the flow moves to step S106 and it is determined to operate the second hearing aid 2 on the slave side in low power consumption mode. Next, a command is sent from the power consumption controller 106*a* to the communication component 107*a* to switch hearing aid processing. Upon receipt of the command to switch hearing aid processing from the power consumption controller 106*a*, the communication component 107*a* sends the communication component 107*b* this command as part of the data it sends to the communication component 107*b*.

The communication component 107*b* extracts this command from the received data and forwards it to the power consumption controller 106*b*. Upon receipt of the command from the communication component 107*b*, the power consumption controller 106*b* analyzes the command and recognizes that it is an instruction from the power consumption controller 106*a* to operate the second hearing aid 2 on the slave side in low power consumption mode.

The battery charge detector 105*a* and the power consumption controller 106*a* repeatedly carry out steps S103 and S104 at a period of once an hour, for example. Every time this happens, the flow moves from step S104 to step S102, S105, or S106.

Figure 3:
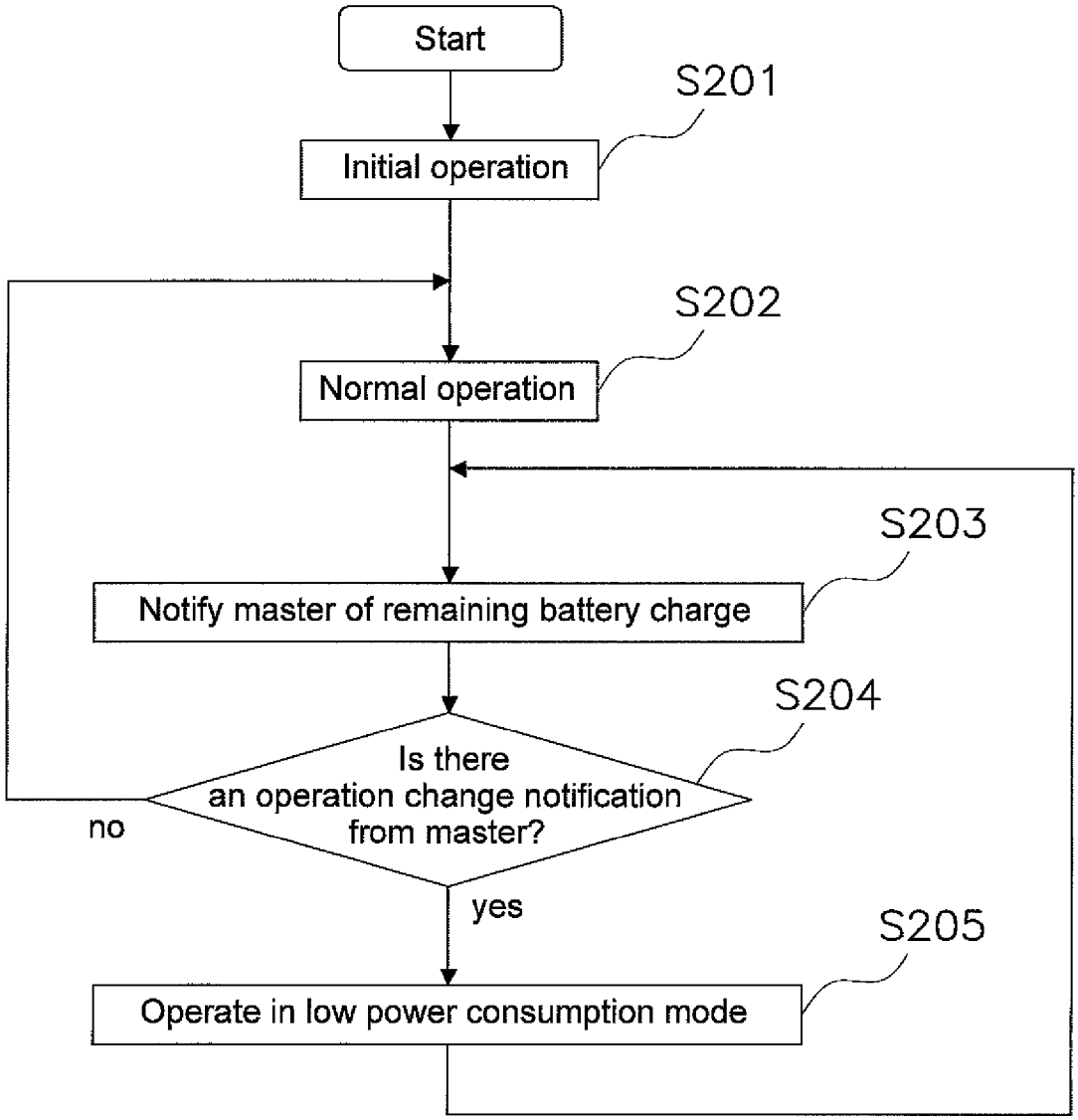
FIG. 3 is a flowchart of the operation of the hearing aid serving as the slave.

FIG. 3 is a flowchart of the processing in the hearing aid 2 on the slave side.

First, in step S201, as the initial operation, it is confirmed that the first and second hearing aids 1 and 2 can communicate with each other, just as in step S101 shown in FIG. 2. Also, the hearing aid processor 102*b* executes initialization of hearing aid processing just as does the hearing aid processor 102*a*.

Next, in step S202, just as in step S102, the electrical signal acquired from the microphone 101*b* is subjected to the hearing aid processing of normal operation by the hearing aid processor 102*b*.

Next, in step S203, the battery charge detector 105*b* subjects the output voltage of the battery 104*b* to A/D conversion, and outputs the voltage value as the remaining battery charge to the power consumption controller 106*b*. The remaining battery charge is acquired by the same method as in step S103. The power consumption controller 106*b* then transfers the remaining battery charge to the communication component 107*b*.

Next, in step S204, the power consumption controller 106*b* confirms whether or not a notification to switch hearing aid processing has been given from the first hearing aid 1 on the master side. If the notification has not been given, the flow moves to step S202, and normal operation is continued without changing to low power consumption mode. If, on the other hand, notification has been given, the flow moves to step S205. At this point it is decided that notification was given only when a command to switch the hearing aid processing was received from the communication component 107*b*, and the flow moves to step S205.

Step s205 will now be described.

The power consumption controller 106*b* of the second hearing aid 2 on the slave side instructs the hearing aid processor 102*b* to switch the hearing aid processing. The switching of hearing aid processor by the hearing aid processor 102*b* is the same as that in step S105.

The battery charge detector 105*b* and the power consumption controller 106*b* repeat the operation of steps S203 and S204 at a period of once a second, for example. Every time this happens, the flow moves from step S204 to S202 or S205.

Figure 4:
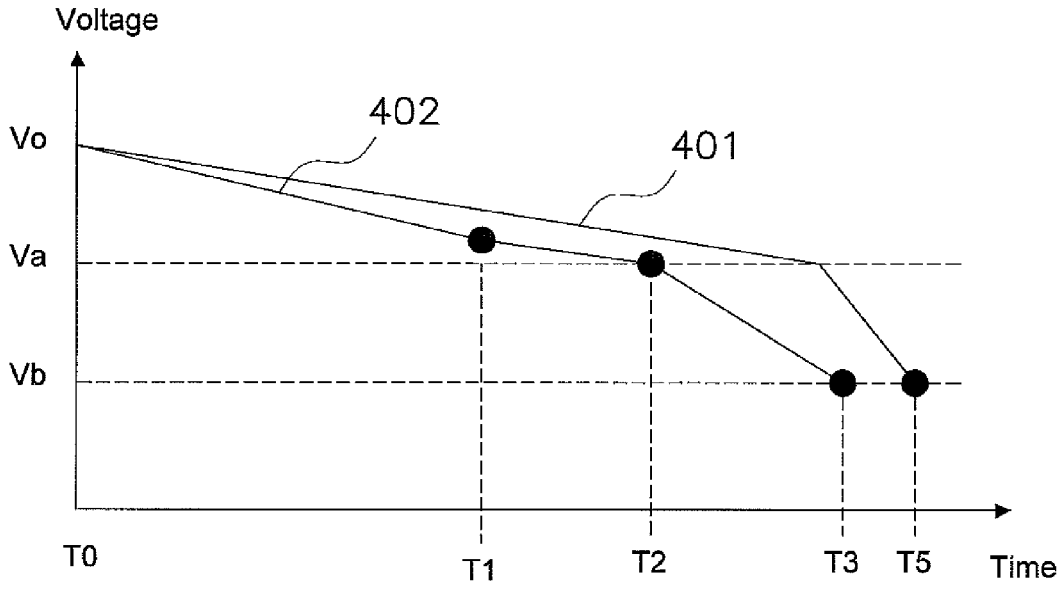
FIG. 4 consists of graphs of the change in remaining battery charge.
Figure 4:
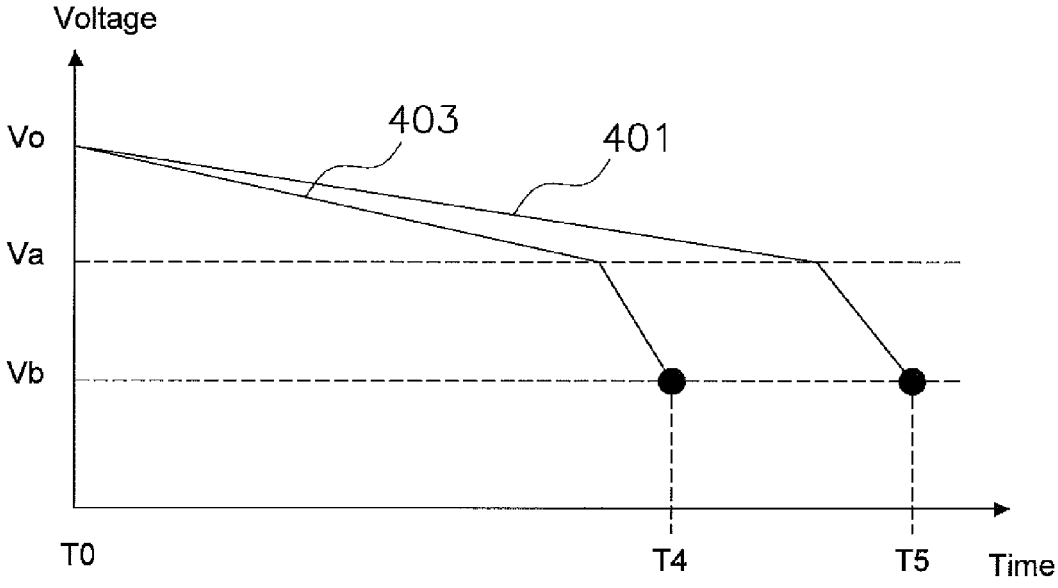

FIG. 4 gives a summary of the voltage changes in the batteries. FIG. 4*a* is when the operation is in low power consumption mode according to the remaining battery charge, and FIG. 4*b* is when only normal operation is performed as in the past. The vertical axis in FIG. 4 is the battery voltage, and the horizontal axis is the operating time.

In FIG. 4, the line 401 indicates the voltage change of the battery 104*a* of the first hearing aid 1, while the line 402 indicates the voltage change of the battery 104*b* of the second hearing aid 2. Specifically, this illustrates an example in which the power consumption of the second hearing aid 2 is always greater than the power consumption of the first hearing aid 1. This can happen, for example, when the user's hearing is different on the left and right, and sound has to be constantly amplified at the ear on which the second hearing aid 2 is worn more than at the other ear.

Also, FIG. 4 shows an example of using an air battery as the battery. Accordingly, if the battery voltage drops below a voltage Va, the proportional reduction in voltage increases. This is due to the characteristics of an air battery. Herein we will assume the voltage Va at which this proportional reduction in voltage changes to be 80% of the cell capacity.

The voltage Vb is the shutdown voltage. The first hearing aid 1 and the second hearing aid 2 stop operating when the battery voltage decreases below this voltage Vb. Here, this shutdown voltage Vb is assumed to be 60% of the battery capacity.

The time T0 is the time at which the batteries 104*a* and 104*b* are attached to the first hearing aid 1 and the second hearing aid 2 and the use of the hearing aids is begun. The voltage at this point is V0. In this embodiment, the power consumption of the second hearing aid 2 is greater than the power consumption of the first hearing aid 1. Accordingly, at the time T1 the voltage of the battery 104*b* is considerably lower (1%) than the voltage of the battery 104*a*. At this point the hearing aid processor 102*b* operates in low power consumption mode in the second hearing aid 2.

Next, when the time T2 is reached, the voltage of the battery 104*b* decreases to the voltage Va, which is 80% of V0, after which the proportional reduction in voltage of the battery 104*b* increases, and the shutdown voltage Vb is reached at the time T3.

From the time T1 until the time T2, the proportional decrease in voltage of the battery 104*b* is substantially the same as the proportional decrease in voltage of the battery 104*a*, and the voltage of the battery 104*b* follows a value that is about 1% lower than the voltage of the battery 104*a*. Although not shown in detail in the drawings, from the time T2 onward, operation in low power consumption mode and normal operation are alternated in the second hearing aid 2, and the slope of the line 402 varies minutely according to this.

This is because the following occurs repeatedly during this time. First, if the difference between the voltage of the battery 104*a* and the voltage of the battery 104*b* is greater than 1% of the voltage of the battery 104*a*, the second hearing aid 2 goes into low power consumption mode, the proportional decrease in the voltage of the battery 104*b* flattens out, and the voltage differential becomes smaller. When the voltage differential then drops under 1%, the second hearing aid 2 goes back to normal operation, and the proportional decrease in the voltage of the battery 104*b* becomes steeper. When this happens, the voltage differential again grows. And when this voltage differential again becomes greater than 1%, the second hearing aid 2 goes back into low power consumption mode.

From the time T2 to the time T3, the voltage decrease becomes steep due to the characteristics of an air battery, so the voltage differential from the battery 104*a* goes over 1%. Since the second hearing aid 2 operates in low power consumption mode, the proportional decrease in the voltage flattens out somewhat, but the voltage differential does not go under 1%. Accordingly, the second hearing aid 2 continues to operate in low power consumption mode until the time T3.

In the conventional operation shown in FIG. 4*b*, meanwhile, the voltage differential is greater than 1% at the time T1, but since the second hearing aid 2 stays in normal operation, there is no change in the slope of the line 403. Therefore, the time T4 at which the battery 104*b* reaches the shutdown voltage is as shown in the drawing.

As a result, the time T3 at which the battery 104*b* reaches the shutdown voltage shown in FIG. 4*a* is closer to the length of time until the time T5 at which the battery 104*a* reaches the shutdown voltage than the time T4 at which the battery 104*b* reaches the shutdown voltage shown in FIG. 4*b*.

Therefore, with this embodiment, when the battery 104*b* has reached the shutdown voltage, the battery 104*a* does not have much usable time left. Accordingly, even if both the battery 104*a* and the battery 104*b* are replaced with fresh batteries at the point when the battery 104*b* reaches the shutdown voltage, there will be little loss with the battery 104*a*.

The hearing aid system of this embodiment, as discussed above, comprises the first hearing aid 1 and the second hearing aid 2 that are mounted on the left and right ears. The hearing aid 1 and the second hearing aid 2 respectively comprise the battery charge detectors 105*a* and 105*b* that detect the remaining battery charge, and the power consumption controllers 106*a* and 106*b* that adjust the remaining charge or one or both batteries so that the charge is similar for the first hearing aid 1 and the second hearing aid 2.

Consequently, the batteries can be replaced at substantially the same time for the left and right hearing aids (the first and second hearing aids 1 and 2), the length of time that the hearing aid with the higher power consumption can be extended, and battery replacement is less complicated.

The allowable range for comparing the remaining battery charges in step S104 may be changed according to the remaining battery charge. For example, when the remaining battery charge of the first hearing aid 1 on the master side decreases to 70% or lower, the allowable range is changed to ±3% of the remaining battery charge of the first hearing aid 1 on the master side. Consequently, even if the detection precision of the means for detecting the remaining battery charge is low, it will be possible to reliably compare the remaining battery charges when the voltage value has dropped.

Figure 5:
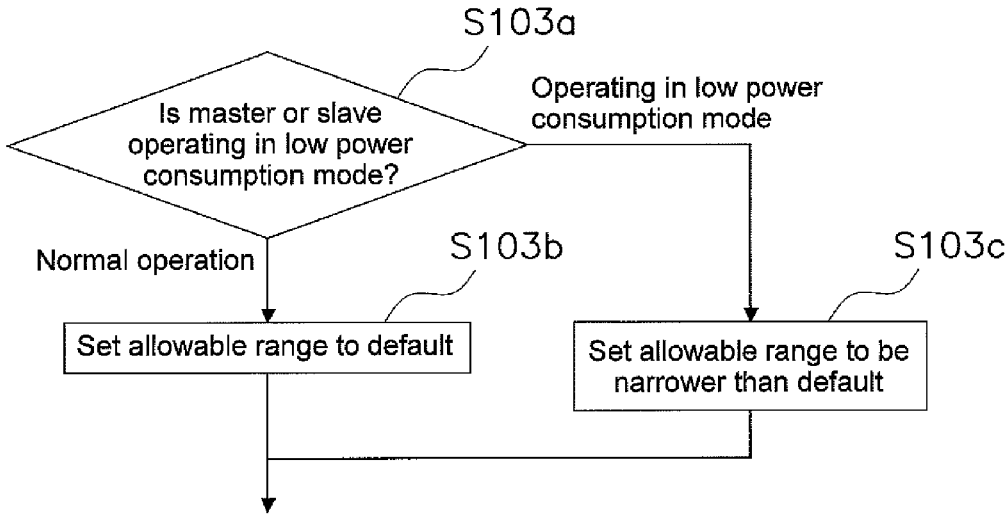
FIG. 5 is a flowchart of setting the allowable range of voltage comparison.

Also, in step S104, the allowable range for comparing the remaining battery charges may be determined as follows. FIG. 5 is a flowchart for determining the allowable range. Steps S103*a* to S103*c* in this flowchart are performed in parallel with step S103, in which the remaining battery charges are compared, every time S103 is performed.

Step S103*a* involves determining whether the hearing aid on the master side or the slave side is operating in low power consumption mode. When both are in normal operation, the flow changes to step S103*b*, and the default allowable range is used. This default is ±3% of the voltage on the side with the higher remaining battery charge.

On the other hand, if the hearing aid on either the master side or the slave side is operating in low power consumption mode, the flow moves to step S103*c*, and the allowable range is narrowed from the default. For example, the allowable range is narrowed to ±1%. An allowable range that has been determined in this manner is used for comparative study of the remaining battery charges in step S104.

Figure 6:
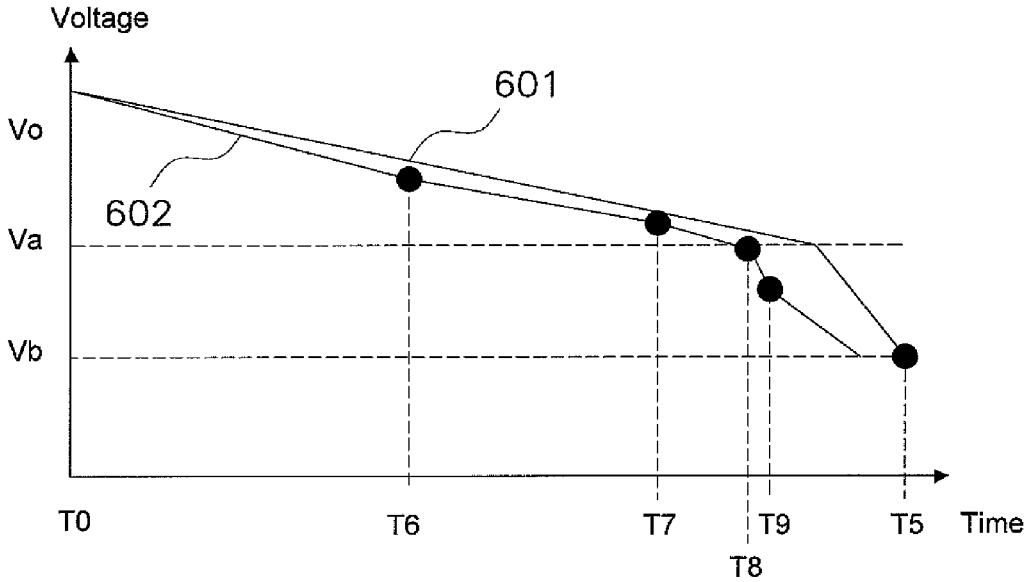
FIG. 6 is a graph of the change in remaining battery charge.

FIG. 6 shows the change in battery voltage when the allowable range was thus varied according to operation switching. This graph shows an example in which the battery consumption of the second hearing aid 2 is greater than the battery consumption of the first hearing aid 1. Here, the line 601 shows the change in voltage of the battery 104*a* attached to the first hearing aid 1, and the line 602 shows the change in voltage of the battery 104*b* attached to the second hearing aid 2.

The voltages Va and Vb shown in FIG. 6 are the same as the voltages Va and Vb shown in FIG. 4. At the time T6, the voltage differential between the battery 104*a* and the battery 104*b* is over 3% of the voltage value of the battery 104*a*. Accordingly, the second hearing aid 2 operates in low power consumption mode. After this, the allowable range is ±1%, so the second hearing aid 2 continues to operate in low power consumption mode until the time T7. When the time T7 is reached, the allowable range is expanded to ±3%, so the second hearing aid 2 is in normal operation.

The time T8 is the point when the voltage of the battery 104*b* drops under 80%, and the battery voltage of the battery 104*b* decreases sharply from this time. When the time T9 is reached, the voltage differential again exceeds ±3%, so the second hearing aid 2 operates in low power consumption mode.

Thus, it is possible to control the system so that switching between normal operation and operation in low power consumption mode is not carried out too often, by dynamically changing the allowable range of the voltage differential between the batteries 104*a* and 104*b*.

The processing performed for operation in low power consumption mode in steps S105 and S205 may be processing in which the input signals of the microphones 101*a* and 101*b* that have undergone A/D conversion are amplified monotonically. For example, when all hearing aid processing is stopped and the processing is switched to a simple form involving only amplification processing in order to move to low power consumption mode, the input signals can be uniformly amplified if a multiplication factor is added to the input signals. This allows a further reduction in the power used for hearing aid processor frequency analysis, amplification processing, howling suppression processing, directionality synthesis processing, environment identification processing, and so forth.

Alternatively, in steps S105 and S205, frequency resolution in hearing aid processor during normal operation may be lowered as a way to achieve operation in low power consumption mode. For example, the number of divisions of the frequency computed in frequency analysis may be set to one-half the number of divisions in normal operation. Halving the number of frequency divisions is accomplished either by processing the number of frequency divisions by twos, or by averaging adjacent frequencies. This affords a reduction in computation performed by the hearing aid processors 102*a* and 102*b*, and a further reduction in the power needed to drive the computation processing circuits.

Or, in steps S105 and S205, operation in low power consumption mode may be achieved by holding down power consumption by delaying the gain computation in normal operation. For instance, the value of the gain added to the input signals by the hearing aid processors 102*a* and 102*b* is computed once every two times. The same gain as before is used for the places not computed. This allows the operating speed of the circuit that computes the gain to be slowed, so power consumption can be further reduced.

Further, in steps S105 and S205, the master and slave in hearing aid processing may be switched in the middle of hearing aid operation. For example, the first hearing aid 1 on the master side may perform computation of hearing aid processing for both ears, and the second hearing aid 2 on the slave side may not perform computation. In this case, the power consumption of the first hearing aid 1 on the master side is larger by an amount equivalent to the computation of hearing aid processing. This allows the remaining battery charges to be adjusted close to each other between the master and slave sides by switching the side that performs hearing aid processing between the master and slave sides.

Also, in steps S105 and S205, the sound volume outputted from the speakers 103*a* and 103*b* may be lowered. For example, if there is a volume adjuster, it can be lowered, or the amount of amplification processing performed by the hearing aid processors 102*a* and 102*b* can be reduced to adjust the sound volume. This allows the power consumption to be cut at the speakers 103*a* and 103*b*.

Also, in steps S105 and S205, one or more types of processing for reducing power consumption may be selected, according to the remaining battery charges, at the power consumption controllers 106*a* and 106*b*. As an example of this selection, priority is given ahead of time to processing for setting to low power consumption mode, and as the difference between remaining battery charges widens, processing is performed in order of highest priority. As an example of how the priority is decided, priority is set higher for processing that has less effect on sound quality, and processing is stopped starting with the one with the highest priority.

If howling is unlikely to occur when the hearing aid is put on, the priority for howling suppression processing is set high, and the priority for amplification processing which affects sound quality is set low. Processing for lowering power consumption is carried out in the order of remaining battery charge, which allows the difference in remaining battery charge to be kept small, and the remaining battery charge to be accurately adjusted. Also, a combination of processing for operation in low power consumption mode can be selected with not just one hearing aid, but with both.

Embodiment 2

Figure 7:
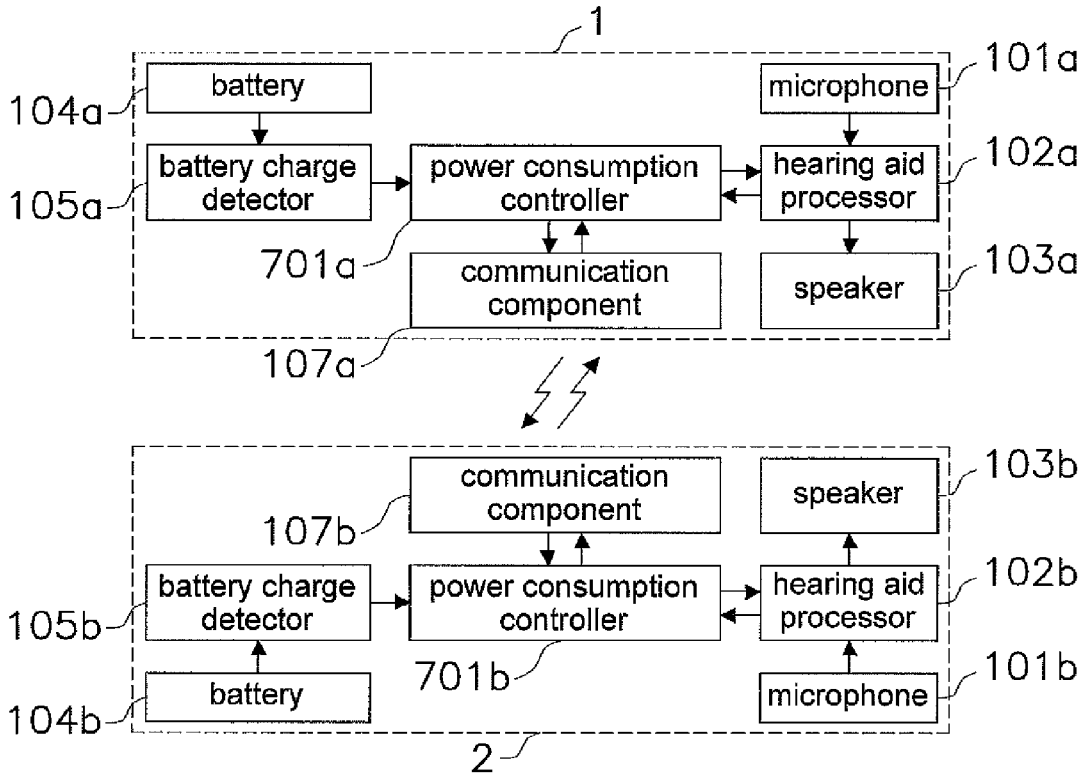
FIG. 7 is a function block diagram of the hearing aid system pertaining to Embodiment 2 of the present invention.

FIG. 7 is a block diagram of Embodiment 2. The various constituent elements in this block diagram that are the same as those in FIG. 1 are numbered the same, and will not be described again.

In this embodiment, what differs from what is shown in FIG. 1 and described in Embodiment 1 above is power consumption controllers 701*a* and 701*b*. The power consumption controllers 701*a* and 701*b* of this embodiment communicate bidirectionally with the hearing aid processors 102*a* and 102*b*. The hearing aid system of this embodiment, as shown in FIG. 7, is the same as that in Embodiment 1 above in that it comprises the first hearing aid 1 and the second hearing aid 2 that are mounted on both ears, and the first hearing aid 1 functions as the master and the second hearing aid 2 as the slave, for example.

Figure 8:
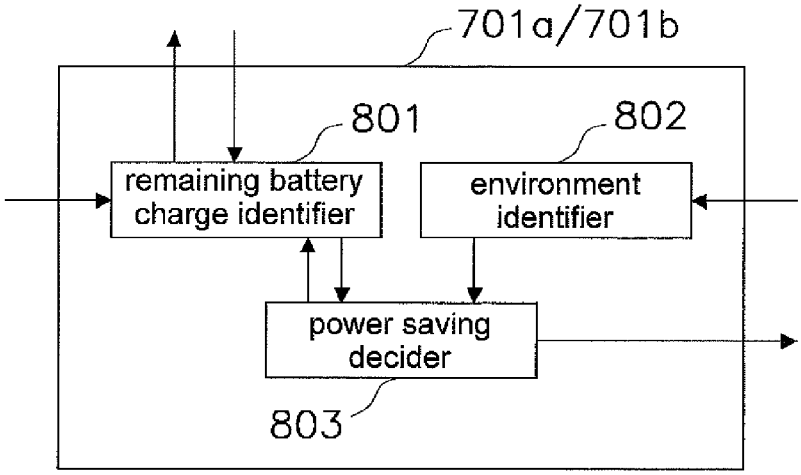
FIG. 8 is a block diagram of a power saver controller included in the function block diagram of FIG. 7.

FIG. 8 is a detailed block diagram of the power consumption controllers 701*a* and 701*b*.

The power consumption controllers 701*a* and 701*b* each have a remaining battery charge identifier 801 an environment identifier 802, and a power saver determination component 803. When the remaining battery charge identifier 801 of the second hearing aid 2 on the slave side receives the remaining battery charge from the battery charge detector 105*b*, it sends it through the communication component 107*b* to the communication component 107*a* of the first hearing aid 1 on the master side, and transmits the remaining battery charge of the battery 104*b* to the remaining battery charge identifier 801 of the first hearing aid 1.

The remaining battery charge identifier 801 of the first hearing aid 1 compares the remaining battery charge of the first hearing aid 1 with that transmitted from the communication component 107*b*. If the difference between the compared remaining battery charges is above a specific range, and the remaining battery charge of the first hearing aid 1 is lower, a notice to the effect that power saving is needed on the first hearing aid 1 side is sent to the power saver determination component 803.

At the environment identifier 802 of the first hearing aid 1, the sound signal inputted from the microphone 101*a* is inputted via the hearing aid processor 102*a*. The environment identifier 802 then evaluates the environment and notifies the power saver determination component 803 of the result. As an example of this environment evaluation, the sound pressure level of the sound signal is used to determine whether or not it is the specified sound pressure level.

The power saver determination component 803 decides, on the basis of information provided by the remaining battery charge identifier 801 and the environment identifier 802, which of the functions to stop among the hearing aid processing if power saving on the first hearing aid 1 side, notifies the hearing aid processor 102*a*, and sends a notice through the remaining battery charge identifier 801 and the communication component 107*a* to the second hearing aid 2 so that the second hearing aid 2 will operate at normal power consumption.

On the other hand, if the second hearing aid 2 has the lower remaining battery charge, a notice is sent to through the remaining battery charge identifier 801 of the second hearing aid 2, and through the communication components 107*a* and 107*b*, to the power saver determination component 803 so that the first hearing aid 1 operates at normal power consumption and the second hearing aid 2 operates at low power consumption.

At the environment identifier 802 of the second hearing aid 2, the sound pressure level of the sound signal inputted from the microphone 101*b* is inputted via the hearing aid processor 102*b* and evaluated as to whether or not it is the specified sound pressure level, after which a notice is sent to the power saver determination component 803.

The power saver determination component 803 decides, on the basis of information provided by the remaining battery charge identifier 801 and the environment identifier 802, which function to stop out of the hearing aid processing if power saving is needed on the first hearing aid 1 side, notifies the hearing aid processor 102*a*, and sends a notice through the remaining battery charge identifier 801 and the communication component 107*a* to the second hearing aid 2 so that the second hearing aid 2 will operate at normal power consumption.

Figure 9:
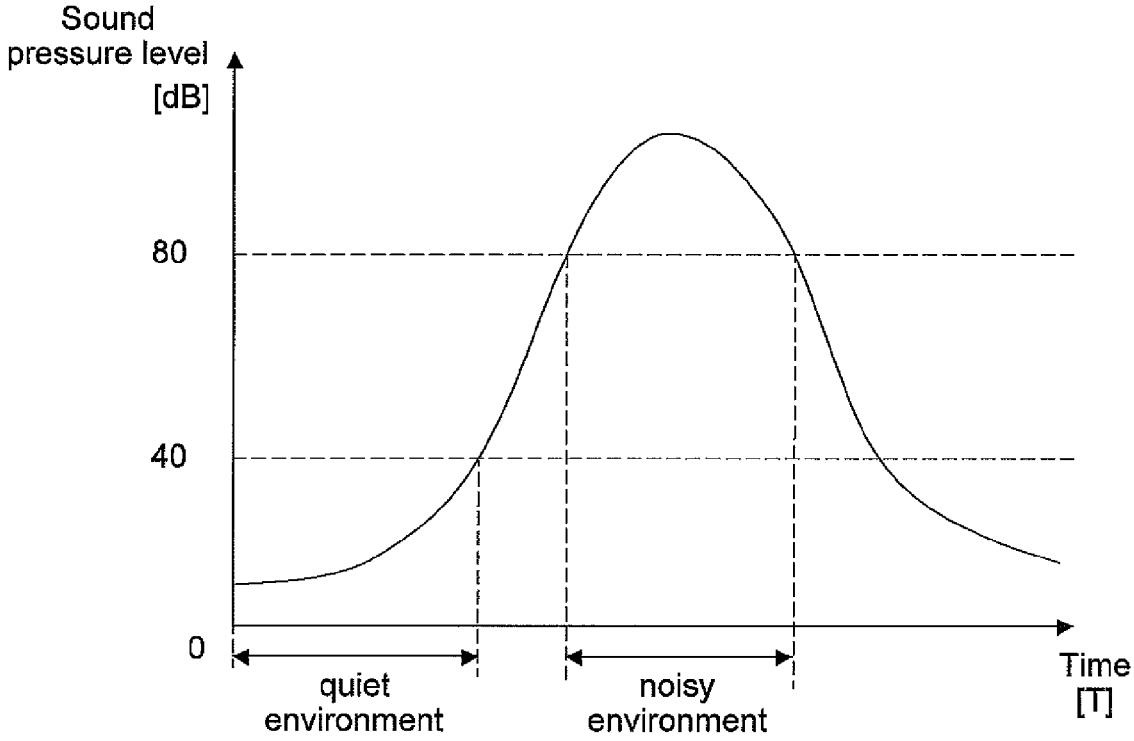
FIG. 9 is a graph illustrating the judging of the sound pressure level.

Next, the decision criteria used by the power saver determination component 803 will be described through reference to FIG. 9. The vertical axis of the graph in FIG. 9 is the sound pressure level inputted by the microphones 101*a* and 101*b*, and the horizontal axis is time.

As to the sound pressure level of ambient sound inputted by the microphones 101*a* and 101*b*, it can be concluded, for example, that the environment is a quiet one, such as the indoors of a house, if the sound pressure level is 40 dB or lower, and is a noisy environment, such as an airport, if the sound pressure level is 80 dB or higher.

If the sound pressure level is 40 dB or lower, that is, in an environment in which the surroundings are quiet, it can be assumed that there is little unpleasant noise to start with, so in this case noise suppression processing can be stopped. Also, since there are no loud noises, it can be assumed that howling is unlikely to occur, so howling suppression processing can also be stopped.

If the sound pressure level is 80 dB or higher, that is, in an environment in which the surroundings are noisy, the noise is also constantly amplified and outputted from the speakers 103*a* and 103*b*, so a situation that is uncomfortable for the user continues. A situation such as this is apt to be encountered at an airport, for example. When the sound pressure level of this noise is higher than the sound pressure level generated by ordinary conversation, it is difficult to decide whether a sound is noise or conversation, and to remove just the noise.

In view of this, discomfort to the user can be reduced, and power consumption decreased, by lowering the overall amount of amplification of sound outputted by the speakers 103*a* and 103*b*.

The operation of a hearing aid system constituted as above will be described in detail through reference to FIGS. 10 and 11.

Figure 10:
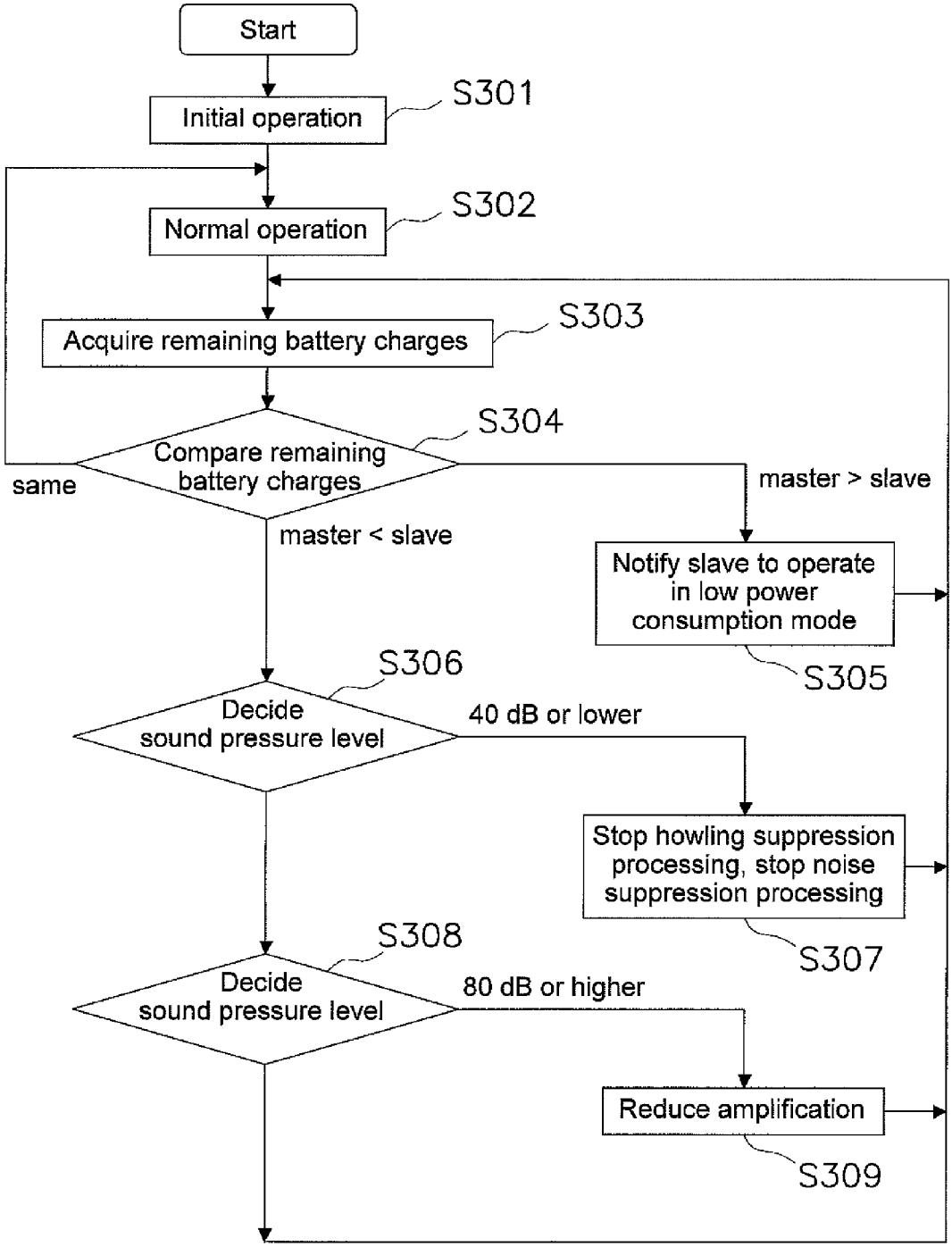
FIG. 10 is a flowchart of the operation of the hearing aid serving as the master.

FIG. 10 is a flowchart of the first hearing aid 1 on the master side. Steps S301 to S305 in FIG. 10 represent the same operation as steps S101 to S104 and S106 in FIG. 2, and therefore will not be described again.

In step S306, the sound pressure level is identified from the ambient sound inputted from the microphone 101*a* and inputted through the hearing aid processor 102*a* to the environment identifier 802. If the level here is 40 dB or lower, the flow moves to step S307.

In step S307, the hearing aid processor 102*a* is instructed to halt howling suppression processing and noise suppression processing.

In step S308, the sound pressure level is identified from the ambient sound inputted from the microphone 101*a* and inputted through the hearing aid processor 102*a* to the environment identifier 802. If the level here is 80 dB or higher, the flow moves to step S309.

In step S309, the amount of amplification at the hearing aid processor 102*a* is reduced in order to lower the sound volume outputted from the speaker 103*a*.

Otherwise, that is, if the sound pressure level is between 40 and 80 dB, it is concluded that an ordinary conversation is being held, and normal operation is continued.

Figure 11:
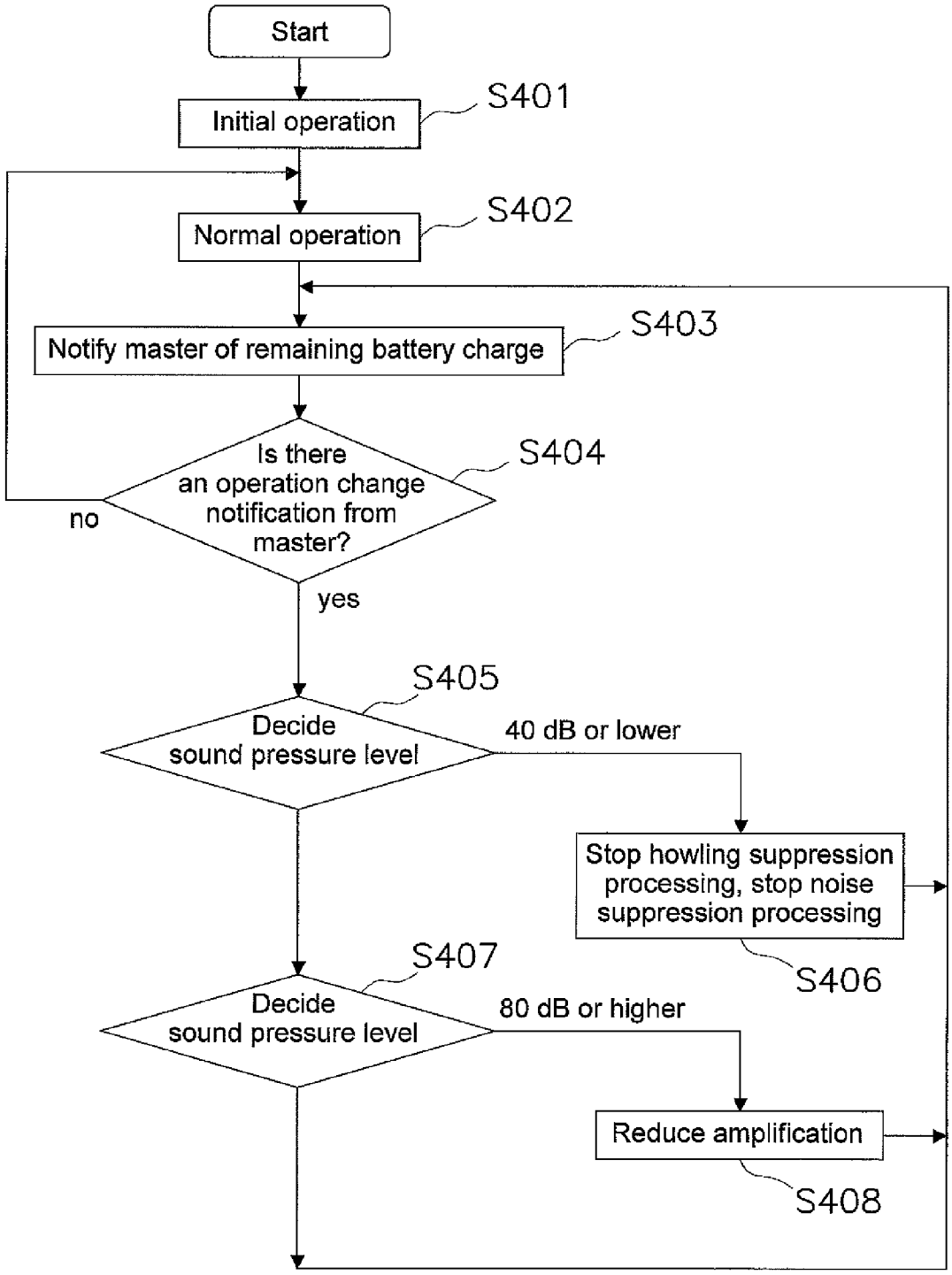
FIG. 11 is a flowchart of the operation of the hearing aid serving as the slave.

FIG. 11 is a flowchart of the second hearing aid 2 on the slave side. Steps S401 to S404 in FIG. 11 represent the same operation as steps S201 to S204 in FIG. 3, and therefore will not be described again.

In step S404, if there has been a notification from the first hearing aid 1 on the master side to move to low power consumption mode, then in step S405 the sound pressure level is identified from the ambient sound inputted from the microphone 101*b* and inputted through the hearing aid processor 102*b* to the environment identifier 802. If the level here is 40 dB or lower, the flow moves to step S406, and howling suppression processing and noise suppression processing at the hearing aid processor 102*b* are stopped.

In step S407, the sound pressure level is identified from the ambient sound inputted from the microphone 101*b* and inputted through the hearing aid processor 102*b* to the environment identifier 802, and if the level is 80 dB or higher, the flow moves to step S408.

In step S408, the amount of amplification at the hearing aid processor 102*b* is reduced in order to lower the sound volume outputted from the speaker 103*b*.

Otherwise, that is, if the sound pressure level is between 40 and 80 dB, it is concluded that an ordinary conversation is being held, and normal operation is continued.

Controlling the system in this way allows the hearing aid with the lower remaining battery charge to be switched to the proper low power consumption mode according to the surrounding environment. As a result, the deterioration in sound quality can be kept to a minimum, while the length of time that the hearing aid with the higher power consumption can be used can be extended.

INDUSTRIAL APPLICABILITY

The hearing aid system pertaining to the present invention has a function of adjusting the remaining battery charges of the first hearing aid and the second hearing aid to be equal, which is also useful for acoustic devices that output separate sounds on the left and right under battery drive.

REFERENCE SIGNS LIST

1 first hearing aid
2 second hearing aid
101*a*, 101*b* microphone
102*a*, 102*b* hearing aid processor
103*a*, 103*b* speaker
104*a*, 104*b* battery
105*a*, 105*b* battery charge detector
106*a*, 106*b* power consumption controller
107*a*, 107*b* communication component
701*a*, 701*b* power consumption controller
401, 402, 403, 601, 602 graph line
801 remaining battery charge identifier
802 environment identifier
803 power saver determination component

The invention claimed is:

1. A hearing aid system, comprising a first hearing aid and a second hearing aid mounted on the left and right ears, in which the first hearing aid and the second hearing aid each comprise:

a microphone into which ambient sound is inputted;

a hearing aid processor configured to subject sound inputted from the microphone to hearing aid processing;

a speaker configured to output sound that has undergone the hearing aid processing;

a communication component configured to perform wireless communication between the first hearing aid and the second hearing aid; and a battery configured to supply electrical power to the microphone, the hearing aid processor, the communication component, and the speaker, a battery charge detector configured to detect the remaining charge of the battery; and a power consumption controller configured to perform control so that the power consumption is reduced for whichever of the first hearing aid and the second hearing aid that has the lowest remaining battery charge when it has been detected that the difference in the remaining battery charges of the first hearing aid and the second hearing aid detected by the battery charge detector is greater than a specific value.

2. The hearing aid system according to claim 1, wherein the power consumption controller provided to the first hearing aid compares the remaining battery charge of the first hearing aid with the remaining battery charge of the second hearing aid obtained via the communication component, and determines whether to operate the first hearing aid or the second hearing aid under low power consumption.

3. The hearing aid system according to claim 2, wherein the power consumption controller provided to the second hearing aid operates the second hearing aid at low power consumption upon receipt of a notification to operate at low power consumption from the power consumption controller provided to the first hearing aid, via the communication component.

4. The hearing aid system according to claim 2, wherein the hearing aid processor stops noise suppression processing upon being instructed by the power consumption controller to operate at low power consumption.

5. The hearing aid system according to claim 2, wherein the hearing aid processor stops environment recognition processing upon being instructed by the power consumption controller to operate at low power consumption.

6. The hearing aid system according to claim 2, wherein the hearing aid processor switches to processing in which a sound signal collected by the microphone is monotonically amplified, upon being instructed by the power consumption controller to operate at a low power consumption.

7. The hearing aid system according to claim 2, wherein the hearing aid processor changes to processing in which frequency resolution is lowered, upon being instructed by the power consumption controller to operate at a low power consumption.

8. The hearing aid system according to claim 2, wherein the hearing aid processor changes to a lower incidence of gain computation of signal amplification upon being instructed by the power consumption controller to operate at a low power consumption.

9. The hearing aid system according to claim 2, wherein the hearing aid processor reduces the amount of signal amplification upon being instructed by the power consumption controller to operate at a low power consumption.

10. The hearing aid system according to claim 2, wherein the hearing aid processor stops howling suppression processing upon being instructed by the power consumption controller to operate at a low power consumption.

11. The hearing aid system according to claim 2, wherein the power consumption controller instructs the hearing aid processor to stop a plurality of processes in combination according to the difference in remaining battery charge.

12. A hearing aid system, comprising a first hearing aid and a second hearing aid mounted on the left and right ears, in which the first hearing aid and the second hearing aid each comprise:

a microphone into which ambient sound is inputted;

a hearing aid processor configured to subject sound inputted from the microphone to hearing aid processing;

a speaker configured to output sound that has undergone the hearing aid processing;

a communication component configured to perform wireless communication between the first hearing aid and the second hearing aid; and a battery configured to supply electrical power to the microphone, the hearing aid processor, the communication component, and the speaker, a battery charge detector configured to detect the remaining charge of the battery;

an environment identifier configured to judge the environment from the ambient sound inputted from the microphone; and a power saver determination component configured to detect that the difference in the remaining battery charges of the first hearing aid and the second hearing aid detected by the battery charge detector is greater than a specific value, and performing control so that the power consumption is reduced for whichever of the first hearing aid and the second hearing aid that has the lowest remaining battery charge according to what was detected by the environment identifier.

13. The hearing aid system according to claim 12, wherein the hearing aid processor stops noise suppression processing upon being instructed by the power saver determination component to operate at low power consumption when a quiet state has been detected in its own environment identifier.

14. The hearing aid system according to claim 12, wherein the hearing aid processor stops howling suppression processing upon being instructed by the power saver determination component to operate at low power consumption when a quiet state has been detected in its own environment identifier.

15. The hearing aid system according to claim 12, wherein the hearing aid processor reduces the amount of signal amplification upon being instructed by the power saver determination component to operate at a low power consumption when a detection result has exceeded a specific level in its own environment identifier.

* * * * *